US008151500B2

(12) United States Patent
Lin

(10) Patent No.: US 8,151,500 B2
(45) Date of Patent: Apr. 10, 2012

(54) PHOTO FRAME WITH MESSAGE BOARD FUNCTION

(76) Inventor: Hung Lung Lin, Taipei (TW)

( * ) Notice: Subject to any disclaimer, the term of this patent is extended or adjusted under 35 U.S.C. 154(b) by 169 days.

(21) Appl. No.: 12/732,218

(22) Filed: Mar. 26, 2010

(65) Prior Publication Data

US 2011/0232146 A1 Sep. 29, 2011

(51) Int. Cl.
*G09F 13/18* (2006.01)
*A47G 1/06* (2006.01)

(52) U.S. Cl. ..... 40/546; 40/714

(58) Field of Classification Search ..... 40/714, 40/546, 443; 362/616; 434/408
See application file for complete search history.

(56) References Cited

U.S. PATENT DOCUMENTS

| | | | | |
|---|---|---|---|---|
| 5,555,654 | A * | 9/1996 | Hermann | 40/714 |
| 2002/0163791 | A1* | 11/2002 | Hoelen et al. | 362/31 |
| 2006/0239025 | A1* | 10/2006 | Azorin et al. | 362/559 |
| 2010/0011638 | A1* | 1/2010 | Choi | 40/446 |

* cited by examiner

*Primary Examiner* — Joanne Silbermann
(74) *Attorney, Agent, or Firm* — Leong C. Lei

(57) ABSTRACT

The photo frame contains a frame body, first and second transparent plates, first and second light generating units. The frame body contains a number of side walls and a back cover. The first transparent plate is jointed to the frame body and attached to the back cover with a photo in between. The second transparent plate is arranged to the frame body's front side, parallel to the first transparent plate and forming a gap therebetween. A first light generating unit contains at least a first light generating element configured along a side wall, projecting illuminating light into the gap to create a stereographic impression. The second light generating unit contains at least a second light generating element arranged an edge of the second transparent plate to project blue light into the second transparent plate to manifest fluorescent traces written by a highlighter.

10 Claims, 6 Drawing Sheets

PHOTO FRAME WITH MESSAGE BOARD FUNCTION

(a) TECHNICAL FIELD OF THE INVENTION

The present invention generally relates to photo frames, and more particular to a photo frame also capable of being used as a message board.

(b) DESCRIPTION OF THE PRIOR ART

A photo frame is a common daily commodity for displaying, protecting, and preserving a photo. Its design is usually focused on the visual appearance and there are various photo frames of unique and delicate outlook.

Recently there are photo frames equipped with lighting function. Such photo frame provides illumination to the photo and could also be used as a night lamp. For example, R.O.C. Taiwan Patent No. M320345 teaches an illuminating photo frame where lighting units are configured within an internal chamber of the photo frame. However, as light is projected from behind the photo, the photo's visual content cannot be enhanced. There are also photo frames where light generating units are configured along the edges of the frame and light is projected parallel to the photo. Therefore, only limited illumination to the photo is achieved.

Accordingly, the present inventor provides a novel photo frame which not only obviates the foregoing shortcomings, but also provides additional function to the photo frame.

SUMMARY OF THE INVENTION

An objective of the present invention is to provide a photo frame where light generating elements are arranged along a side wall of the frame body to create scattered light on the displayed photo so as to create a stereographic impression.

Another objective of the present invention is to provide a photo frame that could be used as a message board as well, where highlighter traces written on a transparent plate of the photo frame are manifested when blue light from light generating elements are projected into the transparent plate.

To achieve the foregoing objectives, the photo frame contains a frame body, a first transparent plate, a second transparent plate, a first light generating unit, and a second light generating unit. The frame body contains a number of side walls and a back cover. The first transparent plate is jointed to the frame body and attached to the back cover with a photo in between. The second transparent plate is arranged to the frame body's front side, parallel to the first transparent plate and forming a gap therebetween. A first light generating unit contains at least a first light generating element configured along a side wall, projecting illuminating light into the gap to create a stereographic impression. The second light generating unit contains at least a second light generating element arranged an edge of the second transparent plate to project blue light into the second transparent plate to manifest fluorescent traces written by a highlighter.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
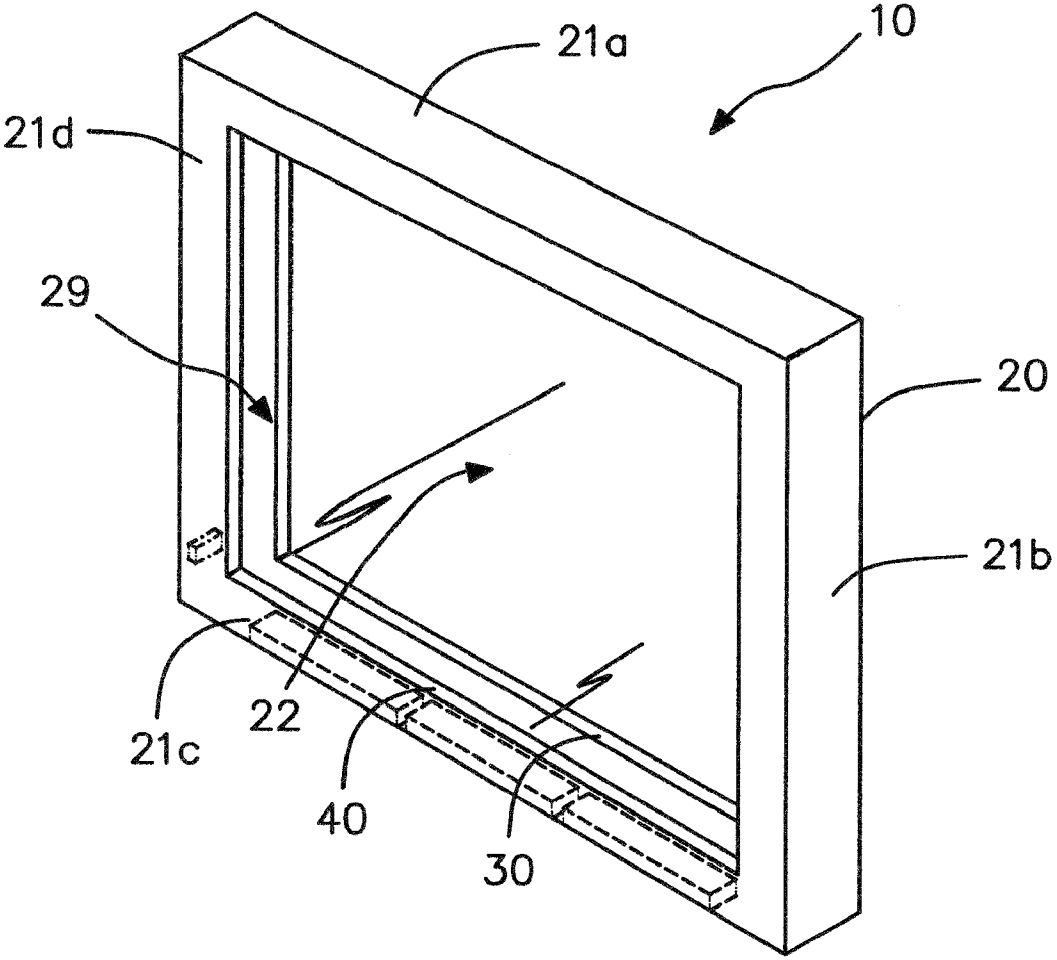
FIG. 1 is a perspective diagram showing a photo frame with message board function according to an embodiment of the present invention.
Figure 2:
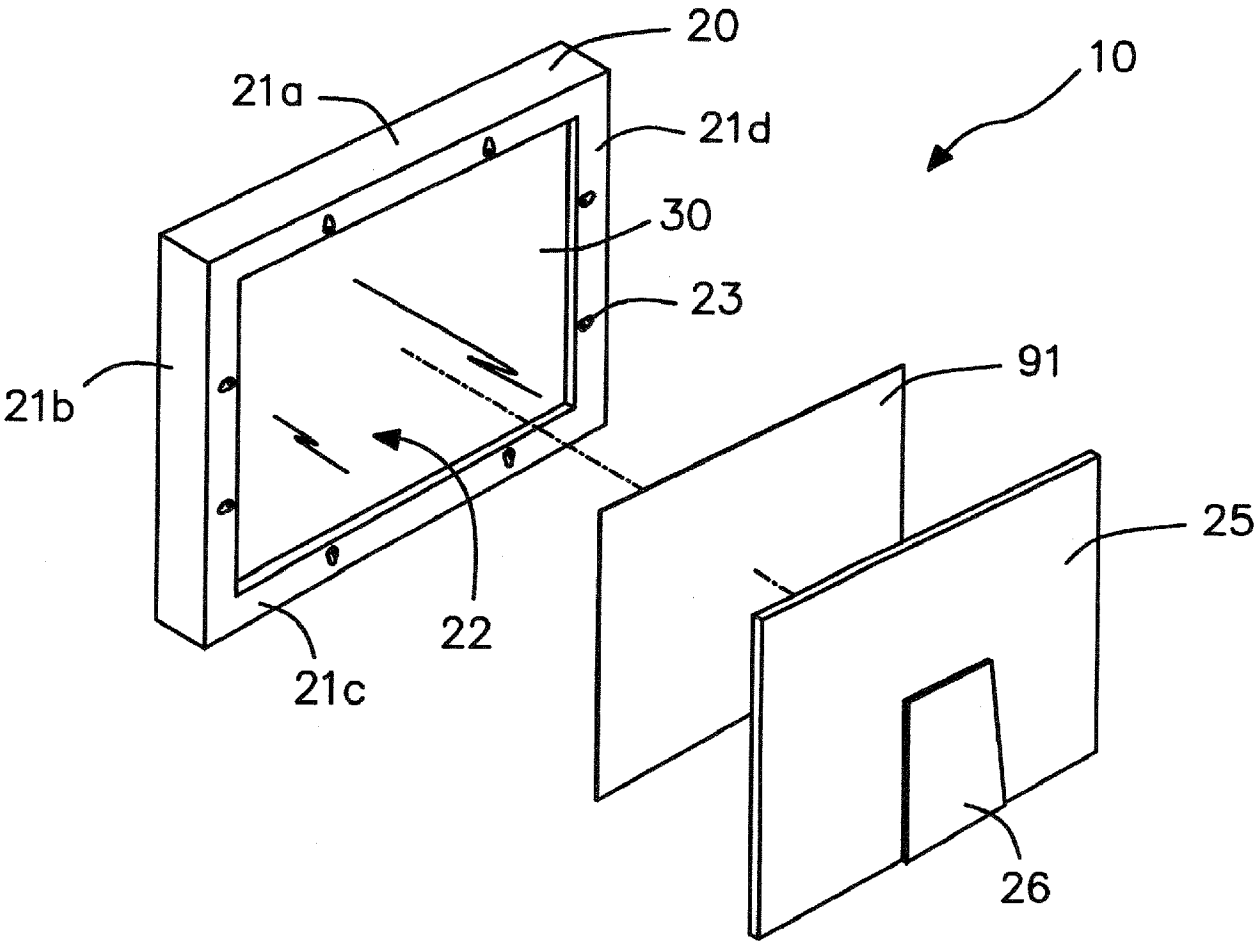
FIG. 2 is a perspective break-down diagram showing the photo frame of FIG. 1 from a different view angle.
Figure 3:
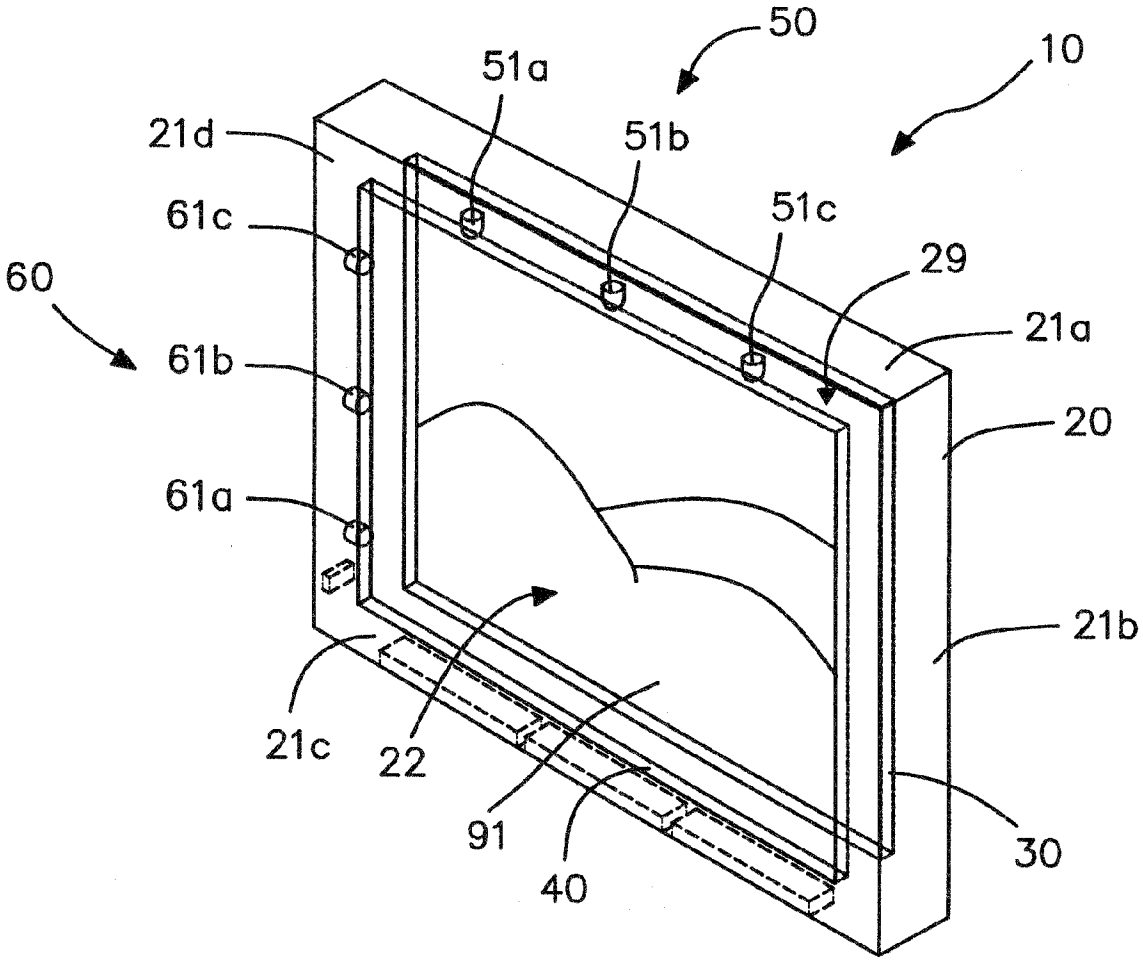
FIG. 3 is a perspective schematic diagram showing the configuration of first and second light generating units on the photo frame of FIG. 1.
Figure 4:
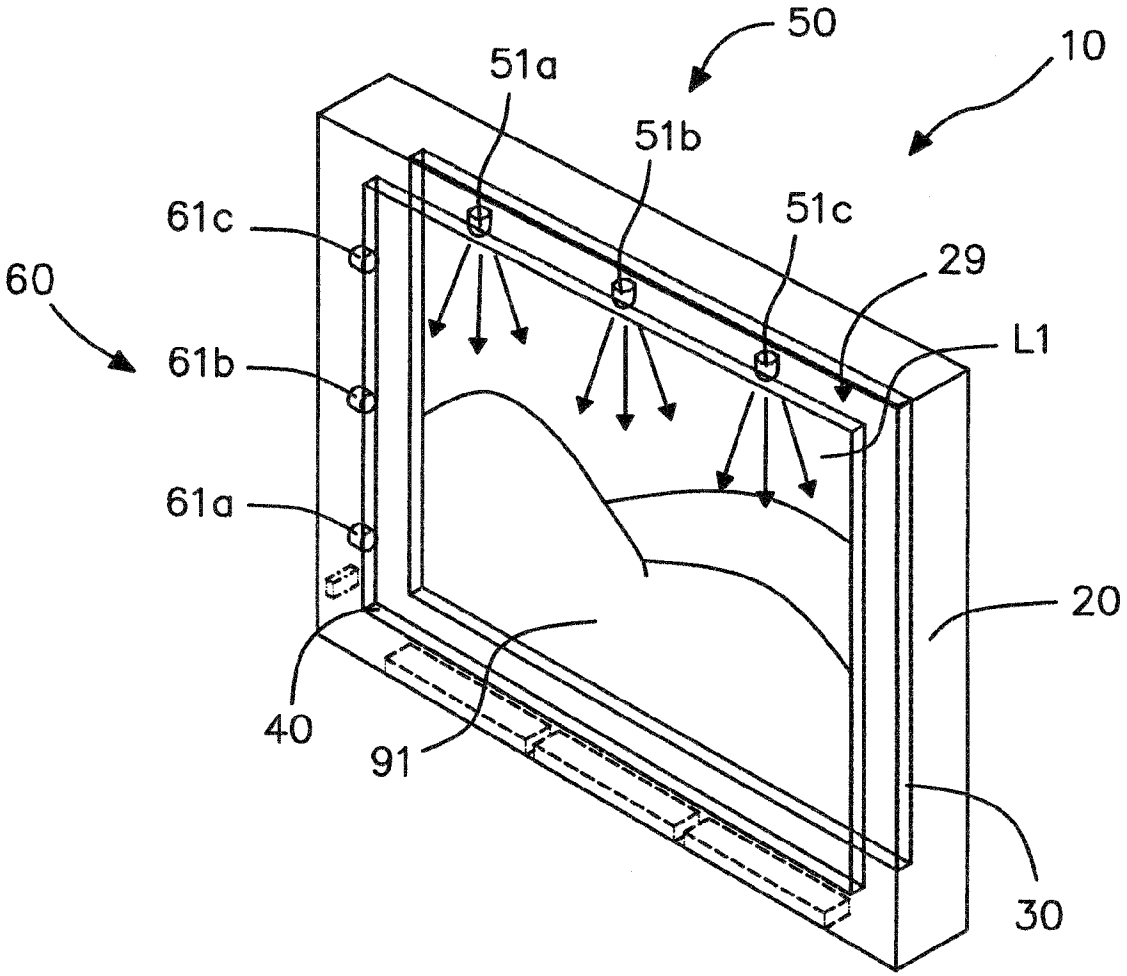
FIG. 4 is a schematic diagram showing an application scenario of the photo frame of FIG. 1.
Figure 5:
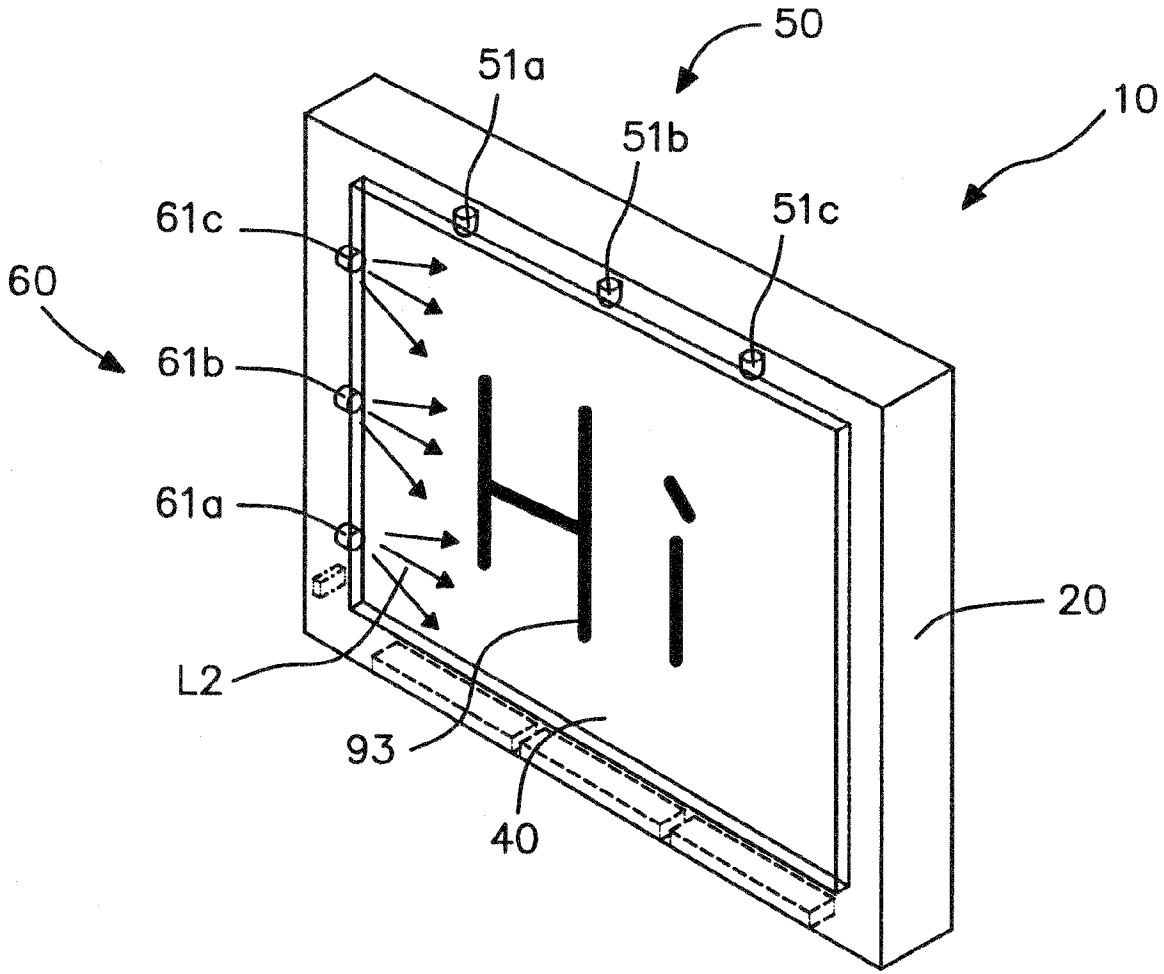
FIG. 5 is a schematic diagram showing another application scenario of the photo frame of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The invention provides a photo frame with message board function. The photo frame is configured with a first light generating unit and a second light generating unit to project illuminating light and blue light, respectively. The illuminating light is diffused over the photo, creating depth and making the photo stereographic. The blue light, on the other hand, illuminates fluorescent ink on a transparent plate of the photo frame so that the photo frame could also be used as a message board.

As shown in FIGS. 1 to 5, a photo frame 10 according to an embodiment of the present invention displays a photo 91 and allows a user to write on it with a highlighter. The photo frame 10 contains a frame body 20, a first transparent plate 30, a second transparent plate 40, a first light generating unit 50, and a second light generating unit 60.

The frame body 20 contains a rectangular frame and a back cover 25. The rectangular frame has four side walls 21*a*, 21*b*, 21*c*, and 21*d*, surrounding a rectangular space 22. The back cover 25 seals a back side of the space 22 and has a retractable support 26. The support 26 could be expanded to raise the photo frame 10 on a flat surface. The back cover 25 is detachably jointed to the frame body 20. The frame body 20 also contains a number of fastening elements 23 on the side walls 21*a*, 21*b*, 21*c*, and 21*d* to keep the back cover 25 attached to the frame body 20.

The first and second transparent plates 30 and 40 are jointed to the frame body 20 to seal the space 22 by being positioned at the back side and a front side of the space 22, respectively. The first transparent plate 30 is attached to the front of the back cover 25 with the photo 91 in between. A gap 29 is formed between the first and second transparent plates 30 and 40. To place the photo 91 in the photo frame 10, the back cover 25 is detached from the frame body 20 first. The photo 91 is then flatly attached to the first transparent plate 30 and the back cover 25 is restored. The photo 91 is then exposed through the first and second transparent plates 30 and 40.

The first light generating unit 50 contains a number of first light generating elements 51*a*, 51*b*, and 51*c*, and a driving circuit. The first light generating elements 51*a*, 51*b*, and 51*c* are positioned along the side wall 21*a* and aimed directly into the gap 29 to project light beams L1. The second light generating unit 60 contains a number of second light generating elements 61*a*, 61*b*, and 61*c*, and a driving circuit. The second light generating elements 61*a*, 61*b*, and 61*c* are positioned along a lateral edge of the second transparent plate 40 to project blue light beams L2 directly into the second transparent plate 40.

Please note that, in addition to the first and second light generating units 50 and 60, a battery and a power adaptor port are also configured within and on the side walls 21*a*, 21*b*, 21*c*, and 21*d*. The photo frame 10 therefore could draw electricity from the battery or an external power adaptor to drive the first light generating elements 51*a*, 51*b*, and 51*c* of the first light generating unit 50 and the second light generating elements 61*a*, 61*b*, and 61*c* of the second light generating unit 60 to project light.

The light beams L1 from the first light generating elements 51*a*, 51*b*, and 51*c* are scattered between the first and second transparent plates 30 and 40 to illuminate the photo 91. The photo 91 would look stereographic and reveals a sense of depth.

A user could write on the second transparent plate 40 with a highlighter to leave a fluorescent trace 93. Under ordinary lighting condition, the fluorescent trace 93 is transparent and could not be recognized. However, when the blue light beams from the second light generating elements 61*a*, 61*b*, and 61*c* are projected into the second transparent plate 40, the fluorescent trace 93 would become vividly visible, making the photo frame 10 more versatile and practical.

Please note that the first light generating elements 51*a*, 51*b*, and 51*c*, and the second light generating elements 61*a*, 61*b*, and 61*c* could be light emitting diodes, light bulbs, or lamp tubes, along with appropriate driving circuits. In addition, the first and second light generating units 50 and 60 could use single or more light generating elements. The multiple light generating elements displayed in the drawing are exemplary only. The frame body 20 is also not limited to the rectangular shape only.

Figure 6:
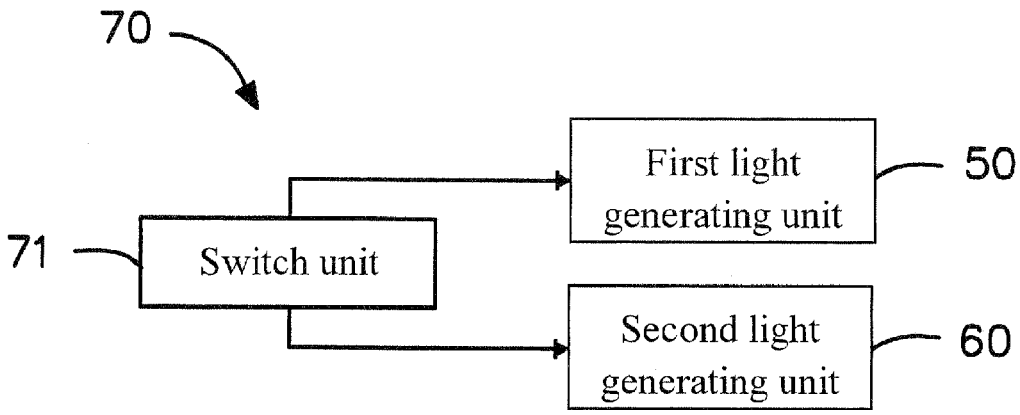
FIG. 6 is a schematic diagram showing a control structure of the light generating units of the photo frame according to a first embodiment of the present invention.

FIG. 6 is a schematic diagram showing a control structure of the light generating units of the photo frame according to a first embodiment of the present invention. As illustrated, a control system 70 of the photo frame 10 uses a single switch unit 71 to control the first and second generating units 50 and 60 together. For example, the switch unit 71 is a multi-stage switch configured on the frame body 20 for user selection to turn on/off the first light generating unit 50 and the second light generating unit 60, individually or together.

Figure 7:
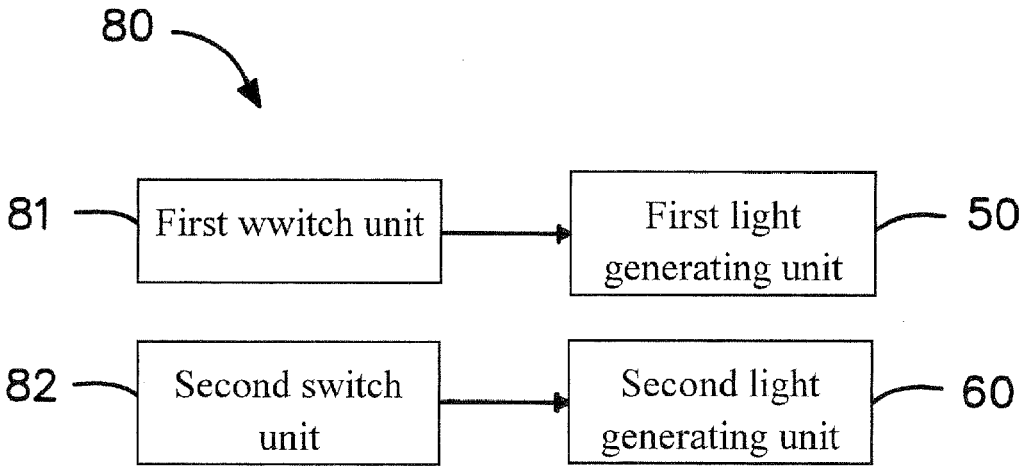
FIG. 7 is a schematic diagram showing a control structure of the light generating units of the photo frame according to a second embodiment of the present invention.

FIG. 7 is a schematic diagram showing a control structure of the light generating units of the photo frame according to a second embodiment of the present invention. As illustrated, a control system 80 of the photo frame 10 uses a first switch unit 81 and a second switch unit 82 to control the first and second generating units 50 and 60, respectively. For example, each of the first and second switch units 81 and 82 is an on/off switch configured on the frame body 20 for user selection to turn on/off the first light generating unit 50 and the second light generating unit 60 separately.

As described, the photo frame with message board function uses a first light generating unit to project light beams scattered between the first and second transparent plates to product a stereographic sense of depth for the displayed photo. Then the photo frame uses a second light generating unit to project blue light beams to manifest the fluorescent ink trace on the second transparent plate so that the photo frame could also be used as a message board. The photo frame is as such more versatile and has more practical value.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A photo frame with message board function for displaying a photo, comprising:

a frame body having a back cover and at least a side wall;

a first transparent plate jointed to said frame body attached to a front side of said back cover where said photo is sandwiched between said back cover and said first transparent plate;

a second transparent plate jointed to said frame body parallel to said first transparent plate forming a gap therebetween;

a first light generating unit having at least a first light generating element configured on said side wall projecting illuminating light beam into said gap; and a second light generating unit having at least a second light generating element configured along a lateral edge of said second transparent plate projecting blue light beam into said second transparent plate.

2. The photo frame according to claim 1, further comprising:

a switch unit controlling said first and second light generating units.

3. The photo frame according to claim 2, wherein said switch unit is a multi-stage switch.

4. The photo frame according to claim 1, further comprising:

a first switch unit controlling said first light generating unit; and a second switch unit controlling said second light generating unit.

5. The photo frame according to claim 4, wherein said each of said first and second switch units is an On/Off switch.

6. The photo frame according to claim 1, wherein said first and second light generating elements are selected from the group consisting of light emitting diode, light bulb, and lamp tube.

7. The photo frame according to claim 1, wherein a battery is configured inside said frame body.

8. The photo frame according to claim 1, wherein said frame body is configured with a power adaptor port for connection with an external power adaptor.

9. The photo frame according to claim 1, wherein said back cover is detachably jointed to said frame body.

10. The photo frame according to claim 9, wherein said back cover is attached to said frame body by a plurality of fastening elements configured on said frame body.

* * * * *